US005799400A

United States Patent [19]

Glesser

[11] Patent Number: 5,799,400

[45] Date of Patent: Sep. 1, 1998

[54] FOLDING KNIFE WITH APERTURE TO RECEIVE A LANYARD

[75] Inventor: Louis S. Glesser, Golden, Colo.

[73] Assignee: Spyderco, Inc., Golden, Colo.

[21] Appl. No.: 790,526

[22] Filed: Jan. 29, 1997

[51] Int. Cl.[6] ..... B26B 1/02

[52] U.S. Cl. ..... 30/298.4; 30/155; 30/340

[58] Field of Search ..... 30/296.1, 298.4, 30/340, 155; 7/188–120

[56] References Cited

U.S. PATENT DOCUMENTS

| | | | |
|---|---|---|---|
| 2,052,741 | 9/1936 | Bersted | 30/155 |
| 2,876,536 | 3/1959 | Dawson | 30/155 |
| 2,889,621 | 6/1959 | Bassett | 30/155 X |
| 3,263,329 | 8/1966 | Hennessey | 30/155 |
| 4,447,950 | 5/1984 | Mizelle | 30/155 |
| 4,985,998 | 1/1991 | Howard | 30/158 |
| 5,546,662 | 8/1996 | Seber et al. | 30/161 |

*Primary Examiner*—Douglas D. Watts

*Attorney, Agent, or Firm*—Sheridan Ross P.C.

[57] ABSTRACT

A folding knife having an aperture positioned at or near the pivot point of the knife blade and knife handle to receive a lanyard for removable attachment to a user of the folding knife or other object.

17 Claims, 9 Drawing Sheets

FOLDING KNIFE WITH APERTURE TO RECEIVE A LANYARD

BACKGROUND OF THE INVENTION

1. Field of the Invention

The present invention relates to a folding knife having an aperture adapted to receive a lanyard cord for the attachment of the knife to a user of the knife or other object. More particularly, the present invention relates to a folding knife having an aperture to receive a lanyard located at or near the pivot point of the knife blade and knife handle to prevent the inadvertent opening of the folding knife when sudden tension is applied to the lanyard.

2. Background of the Invention

Instruments used for cutting such as folding knives may be provided with means for attaching the knife to the user so that the knife cannot fall from the user's reach and be lost. Typically, such attachment devices are in the form of a cord or lanyard that is attached to the knife handle by inserting the cord through a distal end of a knife handle, opposite the blade. The cord is inserted through an aperture in the knife handle, which is commonly referred to as a lanyard hole.

It is important that the aperture and the lanyard cord going through the aperture do not interfere with the operation of the folding knife. Thus, the aperture is traditionally positioned away from the blade on the distal end of the knife. Although in this design the lanyard is not normally in a position to interfere with the operation of the blade, the position of the aperture requires the handle to be oversized to operatively receive the blade in a closed position. That is, without the aperture on the distal end of the knife, the size of the handle portion of the knife may be significantly reduced since the lanyard is not present to occupy critical handle space. Thus, with the aperture positioned on the distal end of the knife, the handle width must be increased to accommodate both the aperture and the knife blade. This additional handle material is not only costly when manufacturing a knife, but may distract from the aesthetic qualities of the folding knife.

Further, folding knives designed with the aperture on the distal end of the knife have been found to inadvertently open when a sudden jarring motion or abrupt tension is applied to the lanyard cord. For example, this can occur when a mountain climber stumbles or falls or when a rafter experiences extreme white water conditions. Any inadvertent opening of the knife blade is extremely dangerous since the knife blade cutting edge becomes exposed and may potentially cut the user of the folding knife or other people or objects in the immediate vicinity.

SUMMARY OF THE INVENTION

It is therefore an object of the present invention to provide an aperture in a folding knife for receiving a lanyard at a location which prevents the inadvertent opening of the blade when the blade is in a closed position or when any abrupt tension is applied to the lanyard. It is a further object of the present invention to provide an aperture in a folding knife at a location which allows the knife to be used without obstruction from the lanyard, yet does not significantly limit the structural strength of the knife. Further, the aperture for receiving the lanyard should be at a location which minimizes the size of the handle on the distal end of the knife and thus reduces the manufacturing costs of the knife.

To achieve the noted objectives, a folding knife is provided which includes an aperture located proximate to or at the pivot point of the knife blade and knife handle. In one embodiment the aperture is located directly at the point of rotation of the blade, while in other embodiments the aperture is slightly offset from the point of rotation of the blade. In either design the lanyard does not obstruct the use of the knife blade and it is virtually impossible for the knife blade to inadvertently open as a result of sudden tension being applied to the lanyard. Furthermore, by locating the aperture near the pivot point of the blade and handle, the width of the handles at the distal end of the knife can be reduced since critical space is not occupied by the aperture and lanyard.

DETAILED DESCRIPTION

The present invention relates to a folding knife, such as a pocket knife, that has an aperture positioned at or near the pivot point of the knife blade and knife handle to minimize interference with the operation of the knife. The aperture is operatively sized to accept a lanyard for removable attachment to a user. A folding knife is a knife where the handle includes two elongated opposed side portions or scales which define a cavity therebetween. The cavity is adapted and sized to receive at least the cutting edge of the blade when the knife is rotated about the pivot point to a closed position, thus reducing the risk of injury to the user when the knife is not in use. The aperture in the present invention is located at or near the pivot point of the knife blade and knife handle to prevent the inadvertent opening of the knife blade when sudden tension is applied to the lanyard. Additionally, the position of the aperture in the present invention facilitates reduced material requirements and hence manufacturing costs of the knife handle.

Accordingly, the opposing side portions of the handle in the present invention includes an aperture extending therethrough and which is adapted to receive a lanyard or similar attachment means. The lanyard is typically a tether, cord, or chain comprised of twine, rope, elastic, metal cable, plastic, cloth or combinations thereof. Alternatively, a clip or other type of attachment means sized to extend through the aperture may be used to attach the folding knife to a user of the folding knife or other object. The aperture is located at or near the pivot point: of the blade and handle, as opposed to the opposite or distal end of the knife.

Figure 1:
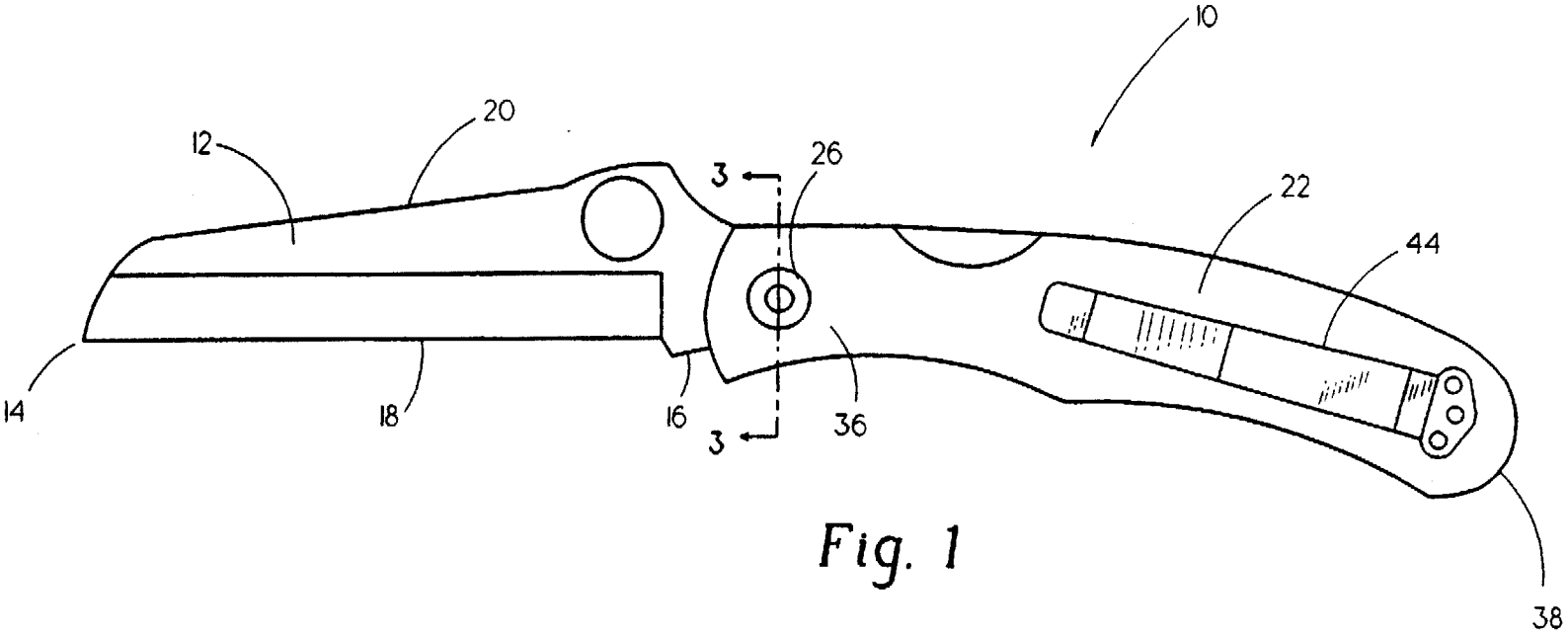
FIG. 1 illustrates a folding knife with the blade extended according to one embodiment of the present invention.

Referring now to the drawings, FIG. 1 illustrates a folding knife 10 according to one embodiment of the present invention. The folding knife 10 includes a blade portion 12 comprised of a cutting end 14, a pivot end 16, a cutting edge 18 and a spine 20. The knife blade 12 is supportably interconnected to a handle portion 22 which has a defined cavity 24 (not seen) for receiving the knife blade 12 when the folding knife 10 is in a closed position. The knife handle 22 is generally comprised of two elongated opposed side portions, commonly known as scales 28. An aperture 26 is provided which extends through both scales 28 and the space therebetween and is positioned proximate to or at a pivot point 32 which allows the knife blade 12 to rotate between a first extended position and a second closed position. In a first extended position, the knife blade 12 is releasably locked into a position which is essentially an extension of the knife handle 22, to facilitate use. In a second closed position, at least a portion of the knife blade 12 is received within the handle cavity 24 to prevent the cutting edge 18 of the knife from being exposed. Thus, the knife handle portion 22 in the present invention includes an aperture 26 which extends entirely through the knife handle 22 and is sized to receive a lanyard 30 to removably attach the folding knife 10 to the user of the knife or any other object when not in use.

In an alternative embodiment seen in FIG. 1, an attachment clip 44 may additionally be interconnected to one of the scales 28 either at the aperture 26 or other position on the knife handle 22. In the embodiment shown, the attachment clip 44 is interconnected to the knife handle 22 at the handle distal end 38. The clip 44 is operatively sized to permit the removable attachment of the clip 44 to a support member such as an article of clothing, belt, shirt or pant pocket. The attachment clip may be interconnected to the knife handle 22 by means of a rivet, grommet with interconnected threads or by injection molding wherein a plastic attachment clip is integrally connected to the handle 22.

Figure 2:
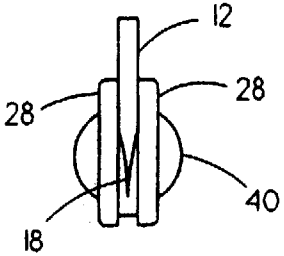
FIG. 2 illustrates a front view of the folding knife of FIG. 1 with the blade extended.

FIG. 2 is a front view of the folding knife 10 of FIG. 1 showing the blade portion 12, opposing scales 28 and a grommet 40 which in this particular embodiment serves the function of holding the knife blade 12 and scales 28 together, providing a point of pivot for the knife blade, and providing an aperture 26 through which to pass the lanyard 30.

Figure 3:
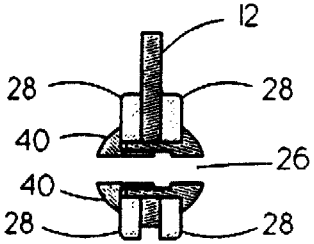
FIG. 3 illustrates a cross-sectional view of the folding knife of FIG. 1 taken at Line 3—3.

FIG. 3 depicts a sectional view of the folding knife 10 of FIG. 1 taken at Line 3—3. As shown, the knife handle 22 is comprised of opposing scales 28 and a grommet 40 which operatively holds the knife blade 12 in position between the scales. The grommet 40 in one embodiment may be a rivet or type of interconnecting device with opposing threaded ends for coupling engagement. The grommet 40 or rivet may be comprised of stainless steel, aluminum, brass, titanium, plastic, fiberglass or any other composition of material commonly known in the art. As seen in FIG. 3, the grommet 40 in this embodiment includes an aperture 26 which extends entirely through the handle 22 to accept a lanyard 30.

Figure 4:
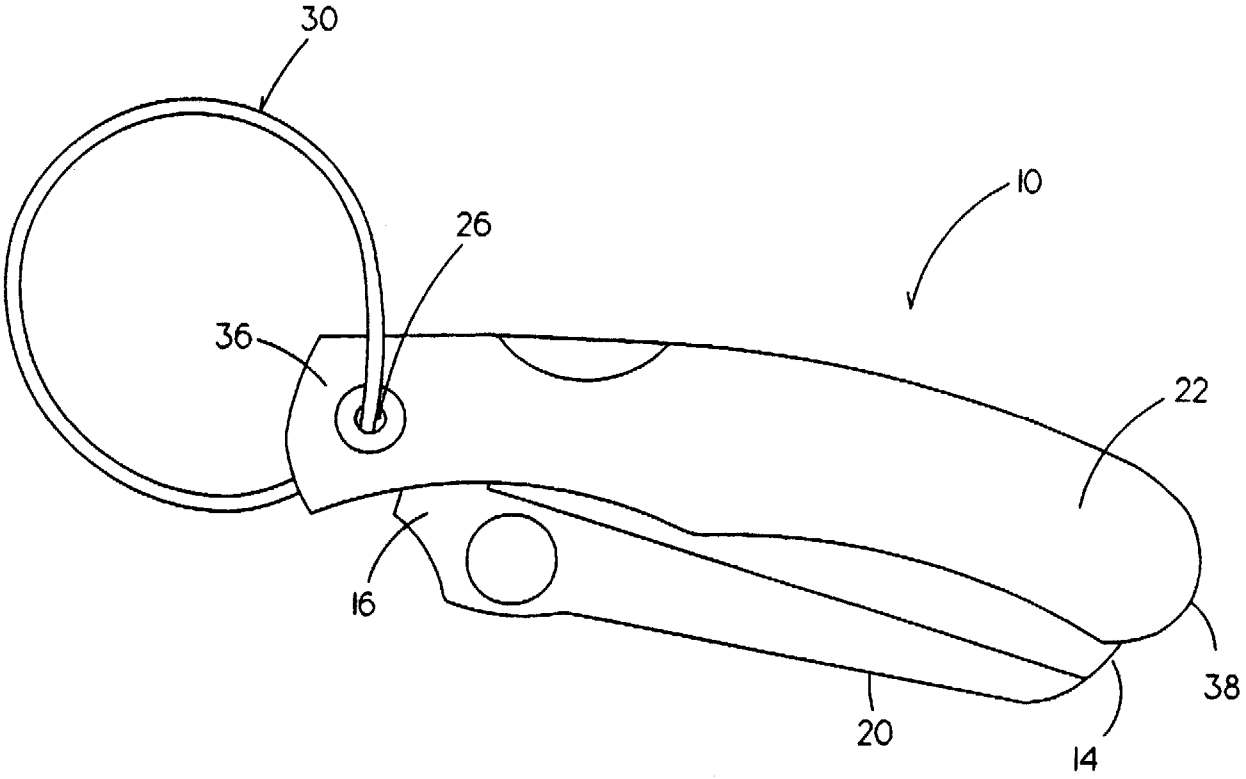
FIG. 4 shows the folding knife of FIG. 1 with the blade in a closed position and a lanyard cord extending through an aperture.

Referring now to FIG. 4, the folding knife 10 of FIG. 1 is shown with the folding knife blade 12 in a closed position with an attached lanyard 30 extending through the aperture 26. The lanyard 30 may be attached to a user of the folding knife 10 or other object to assure that the folding knife 10 is not inadvertently lost. Preferably, the lanyard 30 may have an attached snap, ring, clip, Velcro® or other type of interconnection means to provide removable attachment to a belt loop, jacket or other clothing article worn by the user of the folding knife 10.

Figure 5:
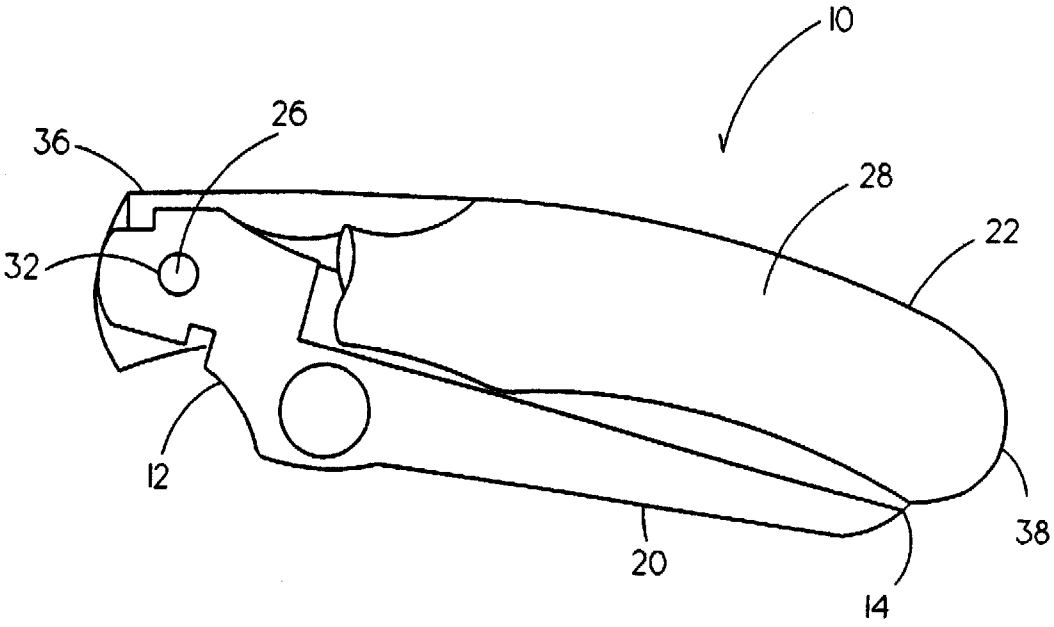
FIG. 5 depicts a cut-away of the handle portion of the folding knife of FIG. 1 with the aperture positioned at the pivot point of the blade and handle.

Referring now to FIG. 5, the folding knife 10 of FIG. 1 is shown with the knife blade 12 in a closed position within the handle portion 22 of the folding knife 10. This figure shows the aperture 26 extending through the point 32 of the blade 12 of the folding knife 10. The aperture 26 is defined by a grommet, rivet or other similar device which acts as the pivot point 32 upon which the blade 12 rotates between a first extended position and a second closed position. This design is advantageous in that the structural integrity of the knife blade 12 is not significantly diminished. As additionally seen in FIG. 5, when the knife blade 12 is in a closed position, the blade cutting edge 18 is substantially received within the knife cavity 24 defined by the scales 28.

Figure 6:
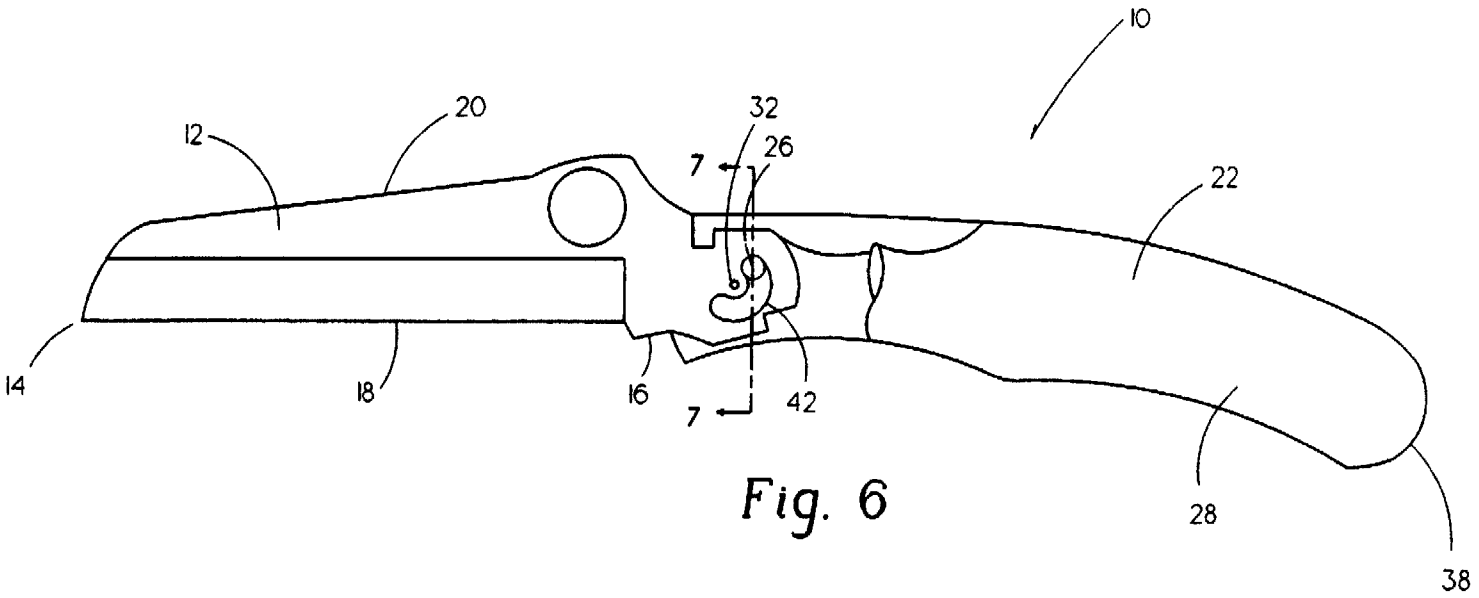
FIG. 6 illustrates a cut-away of an alternate embodiment of a folding knife with the blade in an extended position.
Figure 7:
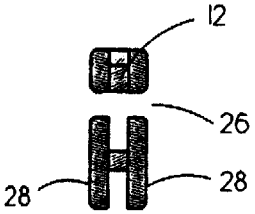
FIG. 7 is a cross-sectional view of the folding knife shown in FIG. 6, taken at Line 7—7.

Referring now to FIG. 6, an alternative embodiment of the present invention is disclosed which shows a folding knife 10 with the blade 12 in an extended position and a portion of the handle 22 removed for illustration purposes. As seen, the aperture 26 is located in a position which is not the pivot point 32 of the folding knife. As a result of the location of the aperture 26, it may be necessary to remove a small arcuate cut-out portion 42 of the blade material at the blade pivot end 16. This allows the knife blade 12 to rotate around the aperture 26 when the knife blade 12 travels between a first extended position and a second closed position. As seen in FIG. 7, which depicts a cross section view of the knife in FIG. 6 taken at line 7—7, the aperture 26 extends entirely through the scales 28 of the folding knife 10, thus allowing a lanyard 30 to be extended therethrough.

Figure 8:
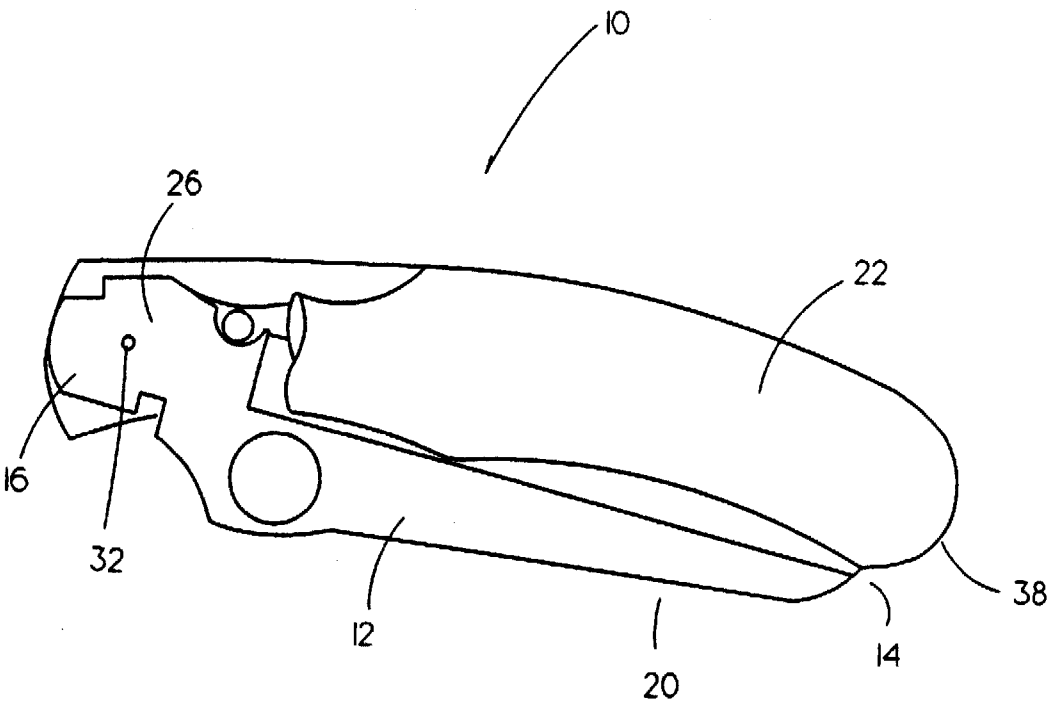
FIG. 8 depicts a cut-away of the handle portion of the knife in FIG. 6 with the blade in a closed position.

Referring to FIG. 8, an alternative embodiment of the folding knife 10 shown in FIG. 6 is depicted with the blade 12 in a closed position within the cavity 24 (not shown) of the folding knife 10. With the handle portion 22 partially removed for illustration purposes, it is possible to identify both the pivot point 32 and the aperture 26 in two distinct locations. In this particular embodiment, a portion of the knife blade pivot end 16 is selectively removed in an arcuate configuration to permit the knife blade 12 to travel between a first extended position and a second closed position within the knife handle 22.

Figure 9:
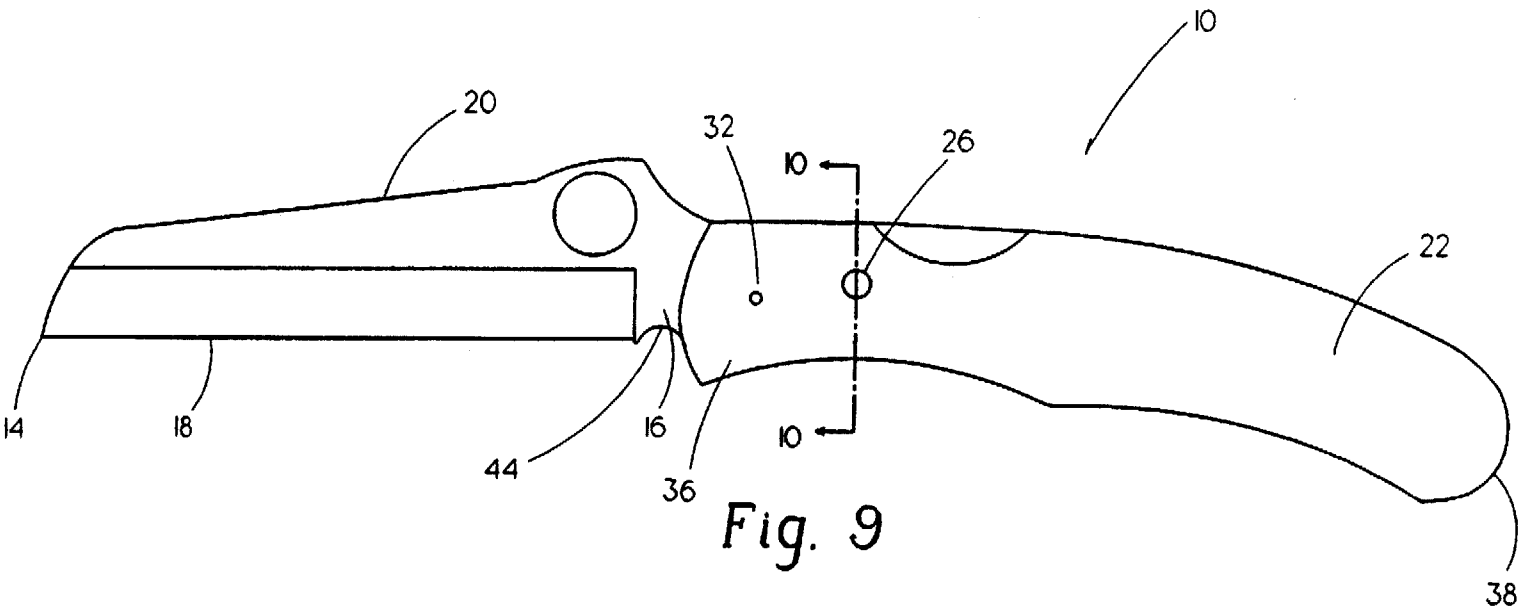
FIG. 9 is an alternative embodiment of a folding knife with aperture with the blade in an extended position.
Figure 10:
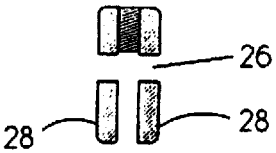
FIG. 10 is a cross-sectional view of the folding knife of FIG. 9 taken at line 10—10.
Figure 11:
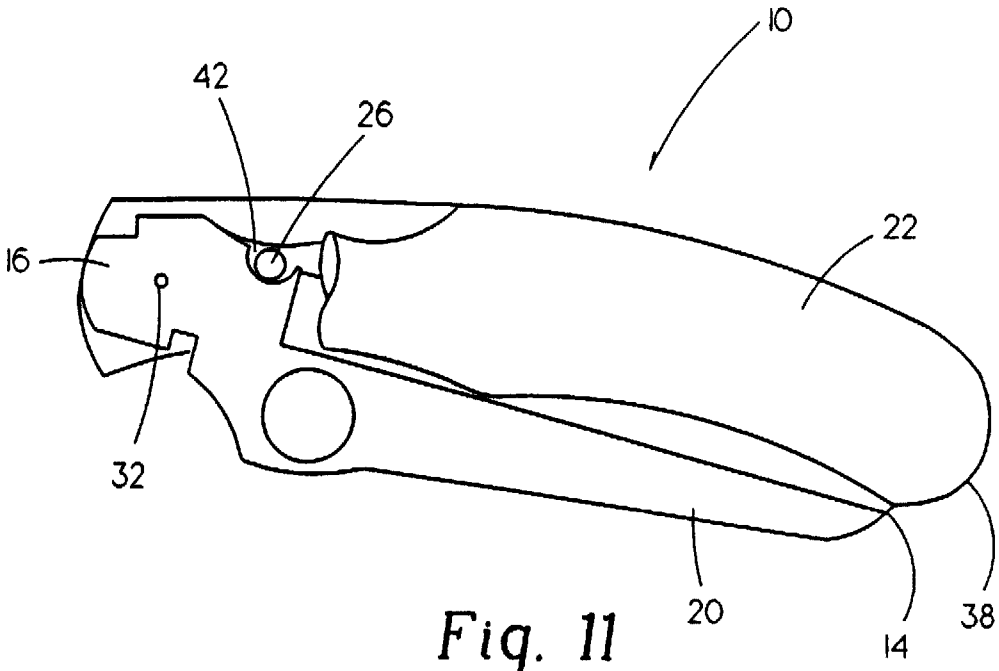
FIG. 11 depicts a cut-away of the handle portion of the folding knife in FIG. 9 with the blade in a closed position.

Referring now to FIGS. 9–11, an alternative embodiment of the present invention is shown wherein the aperture 26 is positioned at yet another location near the pivot point 32 of the knife handle 22 and the knife blade pivot end 16. As shown in FIG. 9, the knife handle 22 is interconnected to the knife blade pivot end 16 at the pivot point 32. The pivot point 32 is at a slightly offset location than the aperture 26. This position of the aperture 26 allows the handle blade 12 to rotate about the pivot point 32, without significantly diminishing the structural integrity of the knife blade 12. Furthermore, an arcuate cut-out portion 42 of the blade 12 is required to allow the blade to properly close around the pivot point 32. However, as can be appreciated by one skilled in the art, any geometric configuration of the arcuate cut-out portion 42 is acceptable which allows the blade to rotate around the pivot point 32.

Referring now to FIG. 10, a sectional view of the folding knife of FIG. 9 is shown taken at line 10—10. As seen, the aperture 26 extends entirely through the scales 28, thus allowing a lanyard or other device to be extended there-through.

Referring now to FIG. 11, the folding knife of FIG. 9 is shown with the blade 12 in a closed position within the cavity 24 (not shown) defined by the opposing scales 28. With a portion of the handle first end 36 removed for illustration purposes, it is possible to see the knife blade pivot end 16 and the pivot point 32. As shown, by placing the aperture 26 in this particular position it may be necessary that a relatively small portion of the knife blade pivot end 16 be removed to accommodate the aperture 26. However, the arcuate cut-out portion 42 of the knife blade 12 does not substantially reduce the structural integrity of the knife.

Figure 12:
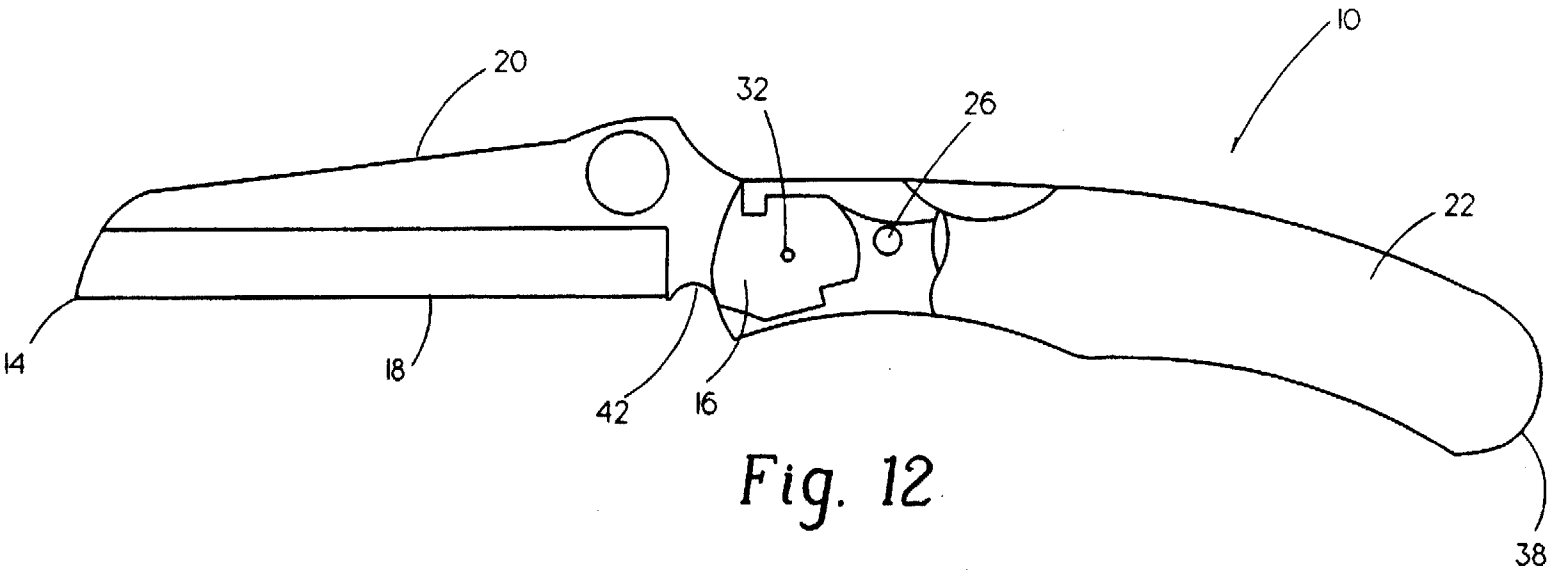
FIG. 12 depicts a cut-away of the handle portion of the folding knife in FIG. 10 with the blade in an extended position.

Referring now to FIG. 12, the knife of FIG. 9 is shown with a portion of the handle first end 36 removed for illustration purposes with a knife blade 12 in an extended position, thus further depicting the aperture 26 and distinct pivot point 32 of the folding knife 10. As seen, the arcuate cut-out portion 42 of the knife blade 12 is minimal, thus not effecting the structural integrity of the folding knife blade 12.

Figure 13:
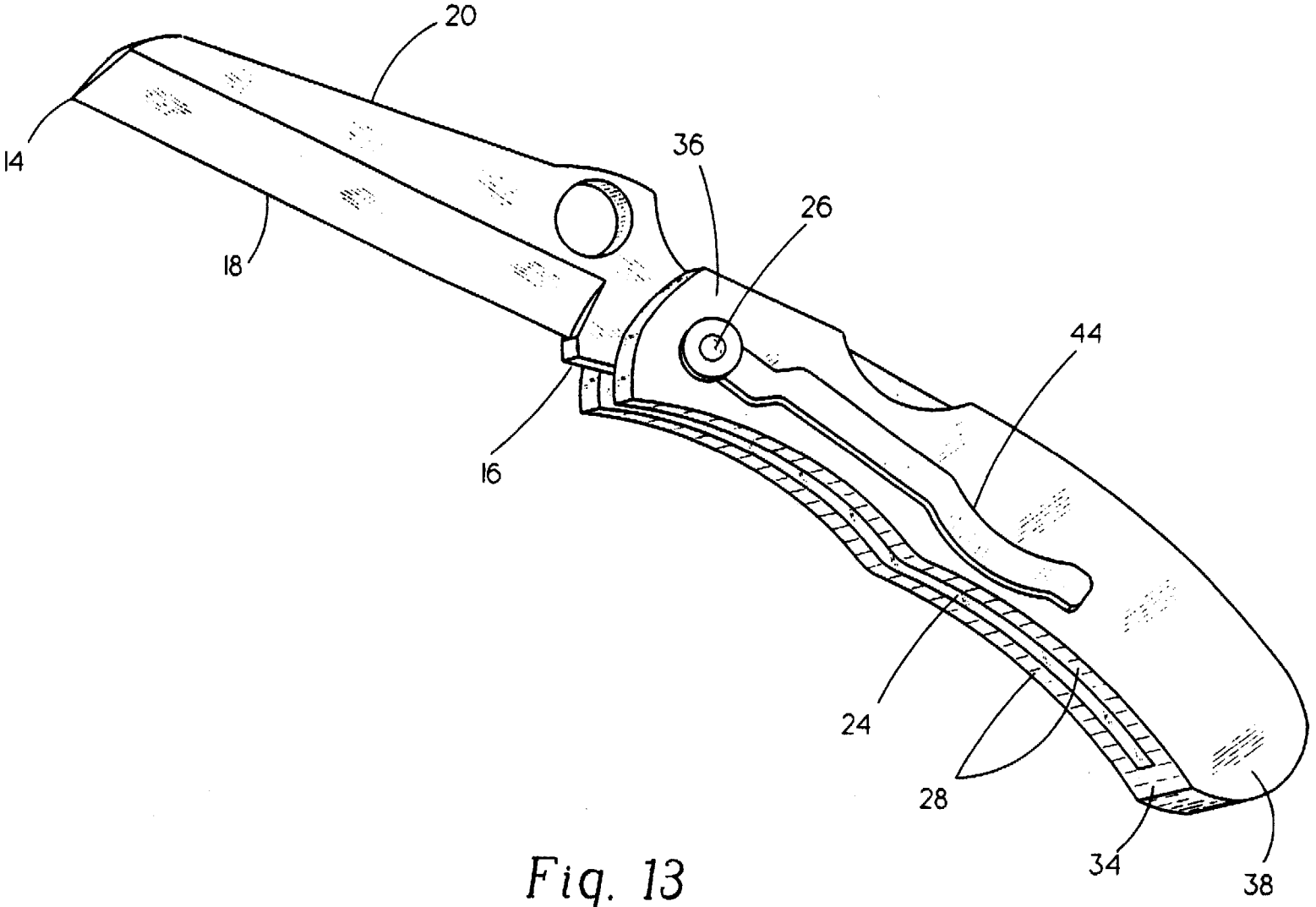
FIG. 13 is a rear perspective view of a folding knife showing opposing scales, spacer and an attachment clip interconnected at the pivot point.

Referring now to FIG. 13, the folding knife 10 of FIG. 1 is shown with the spacer 34 positioned between the opposing scales 28. The spacer 34 helps define the cavity 24 in which the blade rests in a closed position. Furthermore, the spacer 34 provides structural support for the knife handle 22 and prevents the opposing scales 28 from collapsing towards one another when pressure is applied to the scales 28. As seen in FIG. 13, by positioning the knife aperture 26 near the pivot end of the knife blade 12 and knife handle first end 36, it is possible to reduce the total width (w) of the knife handle 22 near the handle distal end 38. This is possible since there is no critical space occupied by the aperture 26 at the distal end 38 of the folding knife 10.

For reference purposes, the following is a detailed list of the described components of the Folding Knife With Aperture, and corresponding numbers as shown in the drawings:

| Number | Component |
|---|---|
| 10 | Folding knife |
| 12 | Blade |
| 14 | Blade cutting end |
| 16 | Blade pivot end |
| 18 | Blade cutting edge |
| 20 | Blade spine |
| 22 | Handle portion |
| 24 | Cavity |
| 26 | Aperture |
| 28 | Scales |
| 30 | Lanyard |
| 32 | Pivot point |
| 34 | Spacer |
| 36 | Handle first end |
| 38 | Handle distal end |
| 40 | Grommet |
| 42 | Arcuate cut-out portion |
| 44 | Attachment clip |

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A folding knife, comprising:

(a) handle means having a first end, a second distal end and opposed elongated side portions defining a cavity therebetween;

(b) blade means having a cutting end and a pivot end, said pivot end pivotally interconnected to said first end of said handle means and movable between a first extended position and a second closed position, wherein in said first extended position said blade is substantially an extension of said handle means and in said second closed position said blade means is at least partially enclosed within said cavity; and (c) an aperture extending through said first end of said handle means proximate to or at a pivoting point of said blade pivot end, said aperture operatively sized to receive attachment means for removable attachment to an object; and (d) a removed portion in said blade means proximate to said pivot end of said blade, said removed portion operatively sized to engage said aperture, wherein said blade means can travel between said first extended position and said second closed position without obstruction from said aperture.

2. The folding knife of claim 1, further comprising attachment means extending through said aperture means for removably attaching said folding knife to an object.

3. The folding knife of claim 2, wherein said attachment means is a lanyard comprised of twine, plastic, cloth, chain, metal cable, elastic or rubbers.

4. The folding knife of claim 1, wherein said aperture comprises opposing grommets with interconnectable threaded couplings, wherein said grommets secure said opposed elongated side portions and said blade means in operable engagement.

5. The folding knife of claim 1, wherein said aperture comprises a rivet with a continuous opening extending there-through.

6. The folding knife of claim 1, further comprising a spacer positioned between said elongated side portions proximate to said second distal end of said handle to further define said cavity and substantially prevent said elongated side portions from collapsing towards said cavity.

7. The folding knife of claim 4, wherein said grommets are comprised of stainless steel, aluminum, brass, titanium, plastic or fiberglass.

8. The folding knife of claim 1, further comprising an attachment clip interconnected to one of said side portions, said clip operatively sized to removably interconnect said folding knife to a support member.

9. A folding knife with an aperture for receiving a lanyard, comprising:

(a) a substantially elongated handle having a first end, a second distal end, and a cavity extending therebetween;

(b) blade interconnection means interconnected to said first end of said handle;

(c) a blade having a cutting end and a pivot end, said pivot end pivotally interconnected to said blade interconnection means, wherein said blade may be pivoted between a first extended position and a second closed position, wherein in said closed position at least a portion of the blade is enclosed within said cavity; and (d) an aperture extending through said substantially elongated handle proximate to said blade interconnection means, said aperture operatively sized to receive attachment means for removably attaching said folding knife to an object; and (e) a removed portion in said blade proximate to said blade pivot end, said removed portion operatively sized to receive said aperture, wherein said blade can travel between said first extended position and said second closed position without obstruction from said aperture.

10. The folding knife of claim 9, wherein said elongated handle comprises two opposing side portions separated by at least one spacer positioned proximate to said second distal end to further define said cavity.

11. The folding knife of claim 9, wherein said blade interconnection means comprises a grommet extending through said handle, wherein said pivot end of said blade rotates around said grommet.

12. The folding knife of claim 11, wherein said grommet is comprised of two opposing head portions and interconnectable threaded couplings, wherein said grommet secures said knife blade to said first end of said elongated handle portion in operable engagement.

13. The folding knife of claim 9, further comprising an attachment means extending through said aperture for removably interconnecting said folding knife to an object.

14. The folding knife of claim 13, wherein said attachment means is a lanyard comprised of cloth, twine, plastic, elastic, rubber, chain or metal cable.

15. The folding knife of claim 13, wherein said attachment means comprises a clip.

16. The folding knife of claim 9, further comprising an attachment clip interconnected to said substantially elongated handle, said clip operatively sized to removably interconnect said folding knife to a support member.

17. The folding knife of claim 9, further comprising an attachment clip interconnected to said substantially elongated handle by said blade interconnection means, wherein said aperture extends through said attachment clip and said substantially elongated handle.

* * * * *